US008121505B2

(12) United States Patent
Jackson

(10) Patent No.: US 8,121,505 B2
(45) Date of Patent: Feb. 21, 2012

(54) HYBRID PRINTING SYSTEM

(75) Inventor: Mark S Jackson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 776 days.

(21) Appl. No.: 12/209,850

(22) Filed: Sep. 12, 2008

(65) Prior Publication Data

US 2010/0067960 A1 Mar. 18, 2010

(51) Int. Cl.
*G03G 15/01* (2006.01)
*G03G 15/20* (2006.01)

(52) U.S. Cl. ..... 399/66; 399/321

(58) Field of Classification Search ..... 399/66, 399/223, 228, 298, 299, 302, 321, 400
See application file for complete search history.

(56) References Cited

U.S. PATENT DOCUMENTS

| | | | | |
|---|---|---|---|---|
| 4,928,148 | A * | 5/1990 | Higashi | 399/321 |
| 5,296,904 | A | 3/1994 | Jackson | |
| 5,325,165 | A * | 6/1994 | Ohgita et al. | 399/321 |
| 5,347,353 | A | 9/1994 | Fletcher | |
| 5,613,176 | A | 3/1997 | Grace | |
| 5,837,408 | A | 11/1998 | Parker et al. | |
| 7,228,088 | B2 * | 6/2007 | Shimmura | 399/101 |
| 7,706,731 | B2 * | 4/2010 | Martin et al. | 399/298 |
| 7,796,906 | B2 * | 9/2010 | Yabuta | 399/66 |
| 2007/0242971 | A1 * | 10/2007 | Goto | 399/82 |
| 2008/0304879 | A1 * | 12/2008 | Tamura | 399/307 |
| 2011/0008078 | A1 * | 1/2011 | Takahashi et al. | 399/302 |

FOREIGN PATENT DOCUMENTS

| | | | |
|---|---|---|---|
| JP | 05341617 | A * | 12/1993 |
| JP | 10055094 | A * | 2/1998 |
| JP | 2001100486 | A * | 4/2001 |
| JP | 2002182447 | A * | 6/2002 |
| JP | 2002189387 | A * | 7/2002 |
| JP | 2005114760 | A * | 4/2005 |
| JP | 2006201743 | A * | 8/2006 |

* cited by examiner

*Primary Examiner* — Robert Beatty
(74) *Attorney, Agent, or Firm* — Fay Sharpe LLP

(57) ABSTRACT

A hybrid printing system includes (a) a media path assembly having an image transfer/transport unit for receiving and moving media to a fusing apparatus; (b) a process color image output terminal (IOT) assembly including first imaging components for forming and transferring color images onto the intermediate image receiving member, the color IOT assembly being mounted for forming a first image transfer nip with one of a first side and a second and opposite of the image transfer/transport unit; and (c) a monochrome image output terminal (IOT) assembly mounted opposite the process color image output terminal (IOT) assembly for forming a second image transfer nip with the other of the first side and the second and opposite of the image transfer/transport unit, the monochrome image output terminal (IOT) assembly including a moveable image bearing member and second imaging components for forming monochrome images on the image bearing member.

17 Claims, 2 Drawing Sheets

HYBRID PRINTING SYSTEM

The present disclosure relates to electrostatographic image producing machines and, more particularly to a hybrid printing system for producing full process color prints and low cost monochrome prints.

BACKGROUND OF THE DISCLOSURE

Generally, electrostatographic imaging is performed in cycles by forming a latent image of an original document onto a substantially uniformly charged photoreceptive member. The photoreceptive member has a photoconductive layer. Ordinarily, exposing the charged photoreceptive member with the image discharges areas of the photoconductive layer corresponding to non-image areas of the original document, while maintaining the charge in the image areas or vice versa. In discharge area development, the reverse is true where the image areas are the discharged areas and the non-image areas are the charged areas. Thus in either case, a latent electrostatic image of the original document is created on the photoconductive layer of the photoreceptive member.

Charged developing material is subsequently deposited on the photoreceptive member to develop the latent electrostatic image areas. The developing material may be a liquid material or a powder material. The charged developing material is attracted to charged or discharged latent electrostatic image areas on the photoconductive layer. This attraction develops the latent electrostatic image into a visible toner image. The visible toner image is then transferred from the photoreceptive member, either directly or after an intermediate transfer step, to a copy sheet or other support substrate as an unfused toner image which is then heated and permanently affixed to the copy sheet, resulting in a reproduction or copy of the original document. In a final step, the photoconductive surface of the photoreceptive member is cleaned to remove any residual developing material in order to prepare it for successive imaging cycles.

In full process color electrostatographic printing, rather than forming a single latent image on the photoconductive surface, separate latent images, corresponding to different color separations, must be created. Each single color latent electrostatic image is developed with a corresponding colored toner. This process is repeated for a plurality of colors. By any one of several processes, each single-color toner image is eventually superimposed over the others and then results in a single full process color toner image on the copy sheet. Thereafter, the full process color toner image is also heated and then permanently fixed to a copy sheet, creating a full-color copy.

In a conventional tandem color printing process, four imaging systems are typically used. Photoconductive drum imaging systems are typically employed in tandem color printing due to the compactness of the drums. Although drums are used in the preferred embodiments, a tandem system can alternatively use four photoconductive imaging belts instead of the drums. Each imaging drum or belt system charges the photoconductive surface thereof, forms a latent image thereon, develops it as a toned image and then transfers the toned image to an intermediate belt or to a print medium. In this way, yellow, magenta, cyan, and black single-color toner images are separately formed and transferred. When superimposed, these four toned images can then be fused, and are capable of resulting in a wide variety of colors.

In image-on-image color printing, an endless photoreceptor belt, a controller and a series of imaging subassemblies are employed that each include a charging unit, a color separation latent image exposure ROS unit or LED print bar, and a corresponding color toner development unit. As the endless photoreceptor belt moves in an indicated direction, an image frame thereon is charged, exposed and developed, in succession, by each imaging subassembly, with each imaging subassembly thus forming a color separation image corresponding to color separation image input video data from the controller. After the first imaging subassembly forms its color separation toner image, that color separation toner image is then recharged and re-exposed to form a different color separation latent image, and then correspondingly developed by the next imaging subassembly. After the final color separation image is thus formed, the fully developed full process color image is then ready to be transferred from the image frame at transfer station to a print media.

Following is a discussion of prior art, incorporated herein by reference, which may bear on the patentability of the present disclosure. In addition to possibly having some relevance to the question of patentability, these references, together with the detailed description to follow, are intended to provide a better understanding and appreciation of the present disclosure.

U.S. Pat. No. 5,347,353 issued Sep. 13, 1994 to Fletcher and entitled "Tandem high productivity color architecture using a photoconductive intermediate belt" discloses a system in which tandem, high productivity color images are formed by using a photoconductive belt as an imaging surface and as a transferring device. A full process colored image is produced comprising a plurality of color layers. The apparatus includes a charging device, an image forming device, and a developing device located along a photoconductive belt to form a toned image layer on the belt. Additional color layers may be provided by either photoreceptive imaging drums or additional photoconductive belts.

U.S. Pat. No. 5,837,408 issued Nov. 17, 1998 to Parker et al. and entitled "Xerocolography tandem architectures for high speed color printing" discloses a full process color imaging system that uses two xerocolography engines in tandem. Each of the two xerocolography engines is capable of creating three perfectly registered latent images with subsequent development thereof in a spot next to spot manner. Each engine is provided with three developer housing structures containing five different color toners including the three subtractive primary colors of yellow, cyan and magenta. Two of the primary colors plus black are used with one of the engines. The third primary color is used with the second tandem engine which also uses one of the primary colors used with the first engine as well as a fifth color which may be a logo or a gamut extending color. The full process color imaging capability provided is effected without any constraints regarding the capability of the laser imaging device to image through previously developed components of a composite image. Also, the development and cleaning field impracticalities imposed by quad and higher level imaging of the prior art are avoided. Moreover, the number of required image registrations compared to conventional tandem color imaging is minimal. Therefore, only one registration is required compared to three or four by conventional tandem engine imaging systems.

U.S. Pat. No. 5,613,176 issued Mar. 18, 1997 to Grace and entitled "Image on image process color with two black development steps" discloses a printing system using a recharge, expose and development image on image process color system in which there is an optional extra black development step. The printing system may be a system where all of the colors are developed in a single pass, or a multi-pass, system where each color is developed in a separate pass. The additional black development step results in optimal color quality with black toner being developed in a first and/or last sequence. Having more than one black development station allows low gloss and high gloss black toner to be applied to the same image, enabling the very desirable combination of low gloss text and high gloss pictorials on the same page.

U.S. Pat. No. 5,296,904 issued Mar. 22, 1994 to Jackson and entitled "Three-roll fuser with center pressure roll for black and color application" discloses a three roll fuser system for a xerographic machine includes a reversibly drivable central pressure roll, a first fuser roll located adjacent the central pressure roll forming a first fuser nip with the central roll, and a second fuser roll located adjacent the central pressure roll on a substantially opposite side of the central pressure roll as the first fuser roll forming a second fuser nip with the central roll. Copy sheets having an unfused image on a side thereof are transported from an inlet through one of the first and second nips to fuse the image on the copy sheet and then transported to an outlet. The three roll fuser system is capable of selectively fusing either side of a copy sheet without requiring extra sheet inverting devices. In a preferred embodiment, the fuser rolls have differing physical properties and can be operated under different operating conditions such as fuser temperature and speed.

In conventional color printing systems with black only image capability, it is well known that the run cost of the color xerographic print engine is much higher than that of a stand alone monochrome black print engine, even when only black images—are being produced. This higher run cost issue has been identified as one of the barriers to greater and faster color printing systems adoption in the office and in lower-volume production markets where providing both a color and monochrome black engine may not be justifiable. This higher run cost issue is also an annoyance to high-volume production customers because incorporating pages from a stand alone low cost monochrome black engine into a mixed job may be even more expensive than printing black pages at the higher run cost on their color print engine.

Conventional printing systems such as those described above can nowadays be found in the office environment as well as in small or entry production environments. The trend by manufacturers however is towards slower color image producing versions that also offer a limited form of "black images" only from the color version. The black image production is limited because color version printers (including the current conventional ones that also offer black images) tend to run at higher run costs per print even when running black images only or in a black mode. The undesirable result is additional wear to the color components as well as higher run costs for each print, color or black.

There is therefore a current need for a printing system that can produce color images as well as black images without the current disadvantages of slower speeds and higher costs for the black images.

SUMMARY OF THE DISCLOSURE

In accordance with the present disclosure, there is provided a hybrid printing system that includes (a) a media path assembly having an image transfer/transport unit for receiving and moving media to a fusing apparatus; (b) a process color image output terminal (IOT) assembly including first imaging components for forming and transferring color images onto the intermediate image receiving member, the color IOT assembly being mounted for forming a first image transfer nip with one of a first side and a second and opposite of the image transfer/transport unit; and (c) a monochrome image output terminal (IOT) assembly mounted opposite the process color image output terminal (IOT) assembly for forming a second image transfer nip with the other of the first side and the second and opposite of the image transfer/transport unit, the monochrome image output terminal (IOT) assembly including a moveable image bearing member and second imaging components for forming monochrome images on the image bearing member.

DETAILED DESCRIPTION

Figure 1:
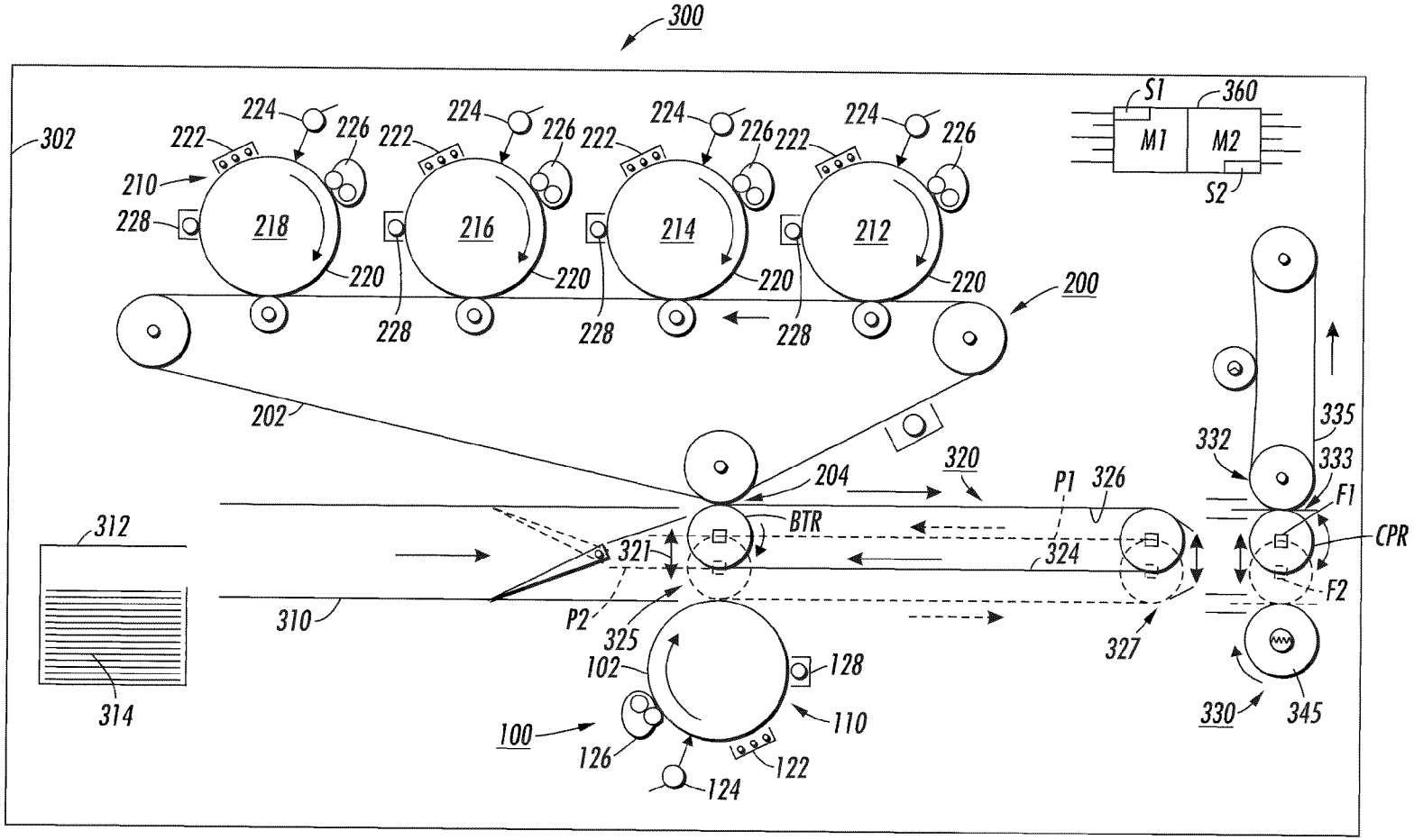
FIG. 1 is a schematic elevational view of the hybrid printing system of the present disclosure showing the novel architecture of a full process color image producing module and a black image output terminal in a full process color image output mode.
Figure 2:
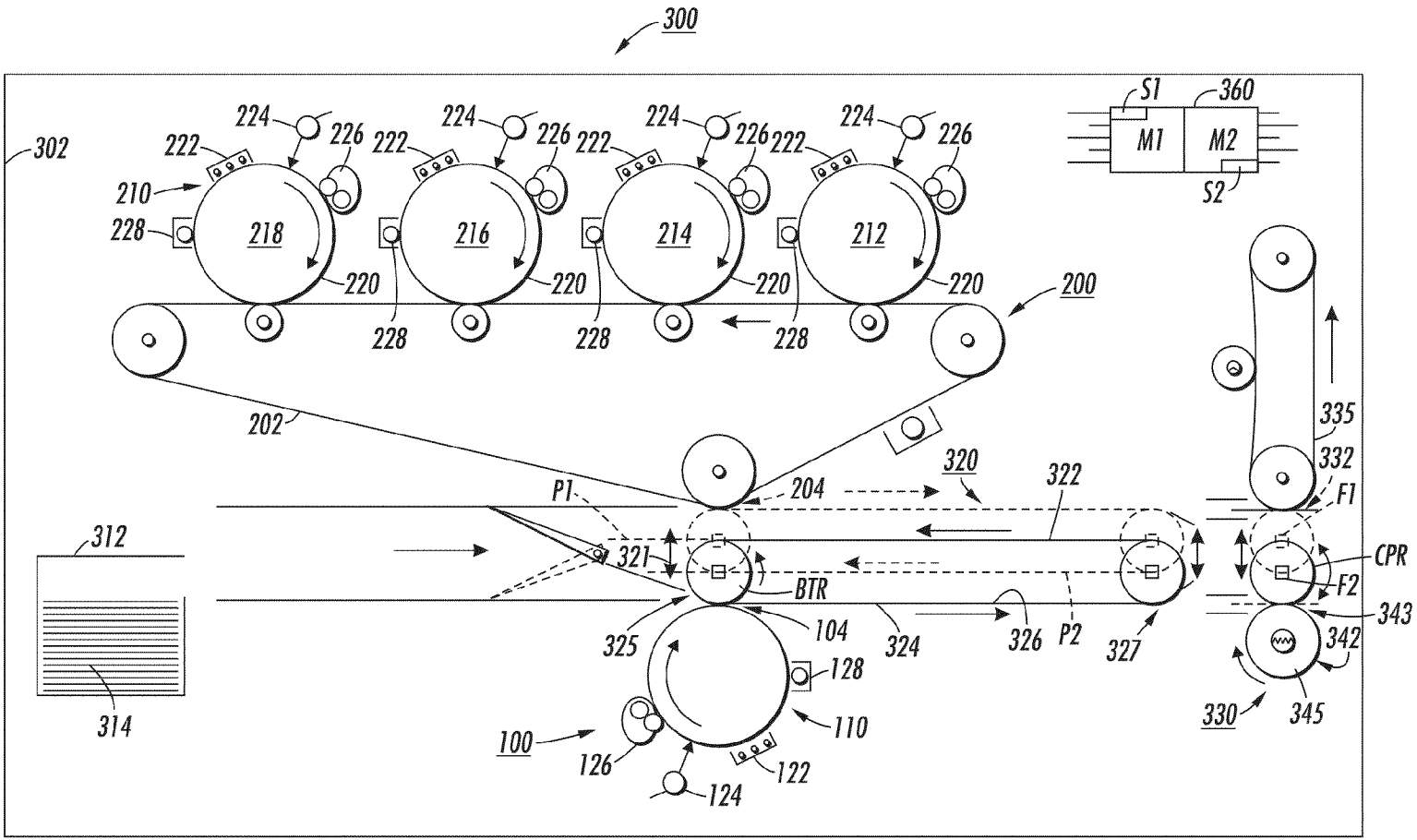
FIG. 2 is the schematic elevational view of the hybrid printing system of FIG. 1 showing the novel architecture of the full process color image producing module and the black image output terminal in a monochrome image output mode.

Referring to the FIGS. 1-2, the hybrid printing system 300 of the present disclosure is illustrated and is suitable for producing full process color prints and low cost monochrome prints. The hybrid printing system 300 includes (a) a machine frame 302; (b) a media path assembly 310 mounted within the machine frame and including a media supply source 312, and an image transfer/transport unit 320 for receiving and moving media 314 to a fusing system 330; and (c) a full process color image output terminal (IOT) assembly 200, which as illustrated includes a moveable intermediate transfer belt or image receiving and carrying member 202, and a first series of components 210 for forming and transferring full process color images X1 onto the intermediate image receiving and carrying member 202 for subsequent transfer onto the image transfer/transport unit 320. Although shown with a moveable intermediate transfer belt or image receiving and carrying member 202, the full process color image IOT as is well known may equally be an image-on-image architecture, or one that transfers directly to paper such as a re-circulating or tandem escorted sheet architecture. The full process color image IOT assembly 200 is mounted so that the intermediate image receiving and carrying member 202 is capable of forming a first image transfer nip 204 with one of a first (shown as a top) side 322 and a second and opposite (shown as a bottom) side 324 of the image transfer/transport unit 320.

Although shown and described with reference to a top side and a bottom side, the first and second sides 322 and 324 would of course be left and right sides in an having a substantially vertical image transfer/transport unit or paper path 320. Additionally, although shown with a single, moveable image transfer/transport unit 320, it should be understood that the hybrid printing system 300 will function equally as well with separate image transfer/transport units (not shown) for the full color module 200 and the monochrome module 100.

The hybrid printing system 300 also includes (d) a monochrome image output terminal (IOT) assembly 100 mounted within the machine frame 302 for forming a second image transfer nip 104 with the other of the top side 322 and the bottom side 324 of the image transfer/transport unit 320, and so as to be opposite the full process color image output terminal (IOT) assembly 200. As illustrated, the full process color image output terminal (IOT) assembly 200 is located on the top side 322 of the image transfer/transport unit 320, but it could equally be located on the bottom side 324 thereof. The monochrome image output terminal (IOT) assembly 100 includes a moveable image bearing member 102 and a second series of components 110 for forming monochrome images X2 on the image bearing member 102 for subsequent transfer at the second image transfer nip 104 onto the image transfer/transport unit 320.

The hybrid printing system 300 further includes a programmable controller 360 that is connected to the full process color image output terminal (IOT) assembly 200, to the monochrome image output terminal (IOT) assembly 100, and to the image transfer/transport unit 320 for controlling various operations thereof. Importantly, the controller 360 includes a full color print engine only mode M1, and a monochrome or black print engine only mode M2.

Additionally, the hybrid printing system 300 also includes a fusing system 330 that is mounted aligned with the image transfer/transport unit 320 for receiving and fusing images X1, X2 on image carrying substrates or media 314. The fusing system 330 as shown includes a first fusing apparatus 332 forming a first fusing nip 333 for fusing full process color images X1, and a second fusing apparatus 342 forming a second fusing nip 343 for fusing monochrome images X2.

The first fusing apparatus 332 and the second fusing apparatus 342 have a common pressure roller CPR for forming one of the first fusing nip 333 and the second fusing nip 343 at any one time. The first fusing apparatus 332 thus includes the common pressure roller CPR and a heated fusing belt 335 forming the first fusing nip 333, and the second fusing apparatus 342 shares the common pressure roller CPR with the first fusing apparatus 332 as shown and includes a heated fuser roller 345 forming the second fusing nip 343 with the common pressure roller CPR. The common pressure roller CPR is moveable as shown by the double headed arrow between a first axial position F1 and a second axial position F2 for forming the first fusing nip 333 in the first fusing apparatus 332, and the second fusing nip 343 in the second fusing apparatus 342.

The image transfer/transport unit 320 includes an endless image transfer/transport belt 326 and has a first end 325 for forming both the first image transfer nip 204 and the second image transfer nip 104. It also has a second end 327 adjacent the fusing system 330, and the second end 327 thereof is moveable as also shown by a double headed arrow between an upper position P1 and a lower position P2 for aligning with the first fusing nip 333 and the second fusing nip 343 respectively. The image transfer/transport unit 320 as shown also includes a biased electrostatic transfer backup roll BTR for assisting image (X1, X2) transfer onto a print media 314 that is on the image transfer/transport unit 320 and is within anyone of the first image transfer nip 204 and the second image transfer nip 104.

More specifically as illustrated in FIGS. 1-2, the hybrid printing system 300 of the present disclosure includes (a) the machine frame 302, (b) the media path assembly 310 (that is mounted pre-fuser) and includes the image transfer/transport unit 320 (which is reversible as shown by the various arrows) for receiving and moving media 314; (c) the process color image output terminal (IOT) assembly 200 (shown as a typical tandem process color system using an intermediate transfer belt 202); and (d) the monochrome image output terminal (IOT) assembly 100 (shown using a drum photoreceptor 102). The process color image output terminal (IOT) assembly 200 is arranged and mounted above, and oppositely of the monochrome image output terminal (IOT) assembly 100, with the media path assembly 310 between them, extending from media source 312 to the fusing system 330.

The reversible image transfer/transport unit 320 for example is a vacuum transport device that in the architectural arrangement of the present disclosure is able to present unfused color images X1 to the fusing system 330 with the images facing up at the heated fusing belt 335, and unfused monochrome black images X2 to the fusing system 330 with the images facing down at the heated fuser roller 345. The fusing system 330 is thus a three-element fusing system having two fusing nips, namely the first fusing nip 333 and the second fusing nip 343, with a common center pressure roller CPR.

The common center pressure roller CPR advantageously is reversible and permits (i) the use of a dedicated fusing element (the heated fusing belt 335) for forming the first fusing nip 333 appropriately suitable for fusing color images X1, and (ii) the use of another and different dedicated fusing element (the heated fuser roller 345) for forming the second fusing nip 343 that is more suitable for fusing monochrome black images X2. The reversible common center pressure roller CPR is additionally moveable as shown by the double headed arrow into a first axial position F1 (up) for forming the first fusing nip 333, and into a second axial position F2 (down) for forming the second fusing nip 343, depending on which of the image output terminals 200, 100 is alternatively being operated.

Advantageously, when one of the image output terminals 200, 100 and its corresponding first and second fusing nips 333, 343 are being used as such, the other and the rest of the elements of the other fusing nip 333, 343 can be decammed or inactivated and therefore not suffer any wear and tear. This is important because the costs of service actions and of replacement of elements due to wear and tear are a significant fraction of the cost of running even monochrome black images on a conventional process-plus black color printing system.

Looked at alternatively, as illustrated in FIGS. 1-2, the hybrid printing system 300 of the present disclosure for example is comprised of (a) an intermediate belt 202 and drum photoreceptor based tandem CMYK color xerographic module 200 and a drum photoreceptor based xerographic black print engine or black image producing module 100 in which each of the modules can be operated alternative to the other and alone. As such, the black image producing module 100 can be operated alone as a low cost stand-alone monochrome black print engine for producing black only images X2. The CMYK full color print engine or full process color image producing module 200 includes drum-based CYM image output terminals 212, 214, 216, and an included K (black) image output terminal 2118, and the intermediate transfer belt 202 on which the image output terminals 212, 214, 216, 218 form the full process color image X1. As is well known, each image output terminal includes an image bearing member 220, and a charging device 222, exposure device 224, development device 226 and cleaning devices 228 (as the first series of components 210) for forming a separate toner image on the image bearing member 220 for transfer onto the intermediate transfer belt or image receiving and carrying member 202.

The CMYK full color print engine or full process color image producing module 200 as such can be operated alone to form process color images X1. The media path assembly 310 is also comprised of a media holding and supply module 312 that is coupled to the image transfer/transport unit 320 as shown. The media holding and supply module 312 for example includes and supplies cut sheet media 314.

As pointed out above, the controller 360 includes a full color print engine only mode M1, and a monochrome or black print engine only mode M2. In the full color print engine only mode M1 (FIG. 1), (a) the black image producing module 100 is inactivated and the CYMK image output terminals 212, 214, 216 and 218 of the full process color image producing module 200 are operated to form a full CYMK color image X1 on the intermediate transfer belt 202 in a conventional manner; (b) the first end 325 of the electrostatic transfer/transport unit 320 under the full process color image producing module 200 is cammed by means 321 into an active or upper position P2 for creating the first or color module image transfer nip 204 that is required to enable image transfer from the full process color image producing module 200.

In this full color print engine only mode configuration, the black print engine 100 is completely inactive and the electrostatic transfer/transport unit 320 carries print media 314 into the first or color module image transfer nip 204 for receiving the full CYMK color image during image transfer. Thereafter, the electrostatic transfer/transport unit 320 carries the print media 314 (bearing the transferred full CYMK color image facing up) through to the first fusing nip 333 of the fusing system 330. As already pointed out, while the hybrid printing system 300 is in the process color image producing mode (FIG. 1), the black print engine 100 will be inactive.

In the (ii) black engine only mode (FIG. 2), (a) the full process color image producing module 200 is inactivated and the black image output terminal 110 of the black print engine 100 is operated in a monochrome fashion to produce black images on the photoreceptor drum 102 at near monochrome rates (speed and cost); (b) the first end 325 of the electrostatic transfer/transport unit 320 is cammed by means 321 into an active or lower position P1 for creating the second black image transfer nip 104 that is required to enable image transfer from the photoreceptor drum 102 during black print engine only printing (FIG. 2).

Thus the full process color mode control M1 of the controller 360 is suitable for operating the hybrid printing system 300 as a full process color machine (FIG. 1) during which the black image producing module 100 is turned off, the first end 325 of image transfer/transport unit 320 is moved into the first color image transfer nip 204 with the intermediate transfer member (image receiving and carrying or belt) 202, and the fusing system 330 is set for fusing with the first fusing nip 333 and transfer/transport unit 320 is aligned with the first fusing nip 333. The full process color mode control M1 for example includes a first throughput speed S1 that is relatively less than a second throughput speed S2 for operating the hybrid printing system 300 in a black mode control M2.

The black mode control M2 is suitable for operating the hybrid printing system 300 as a stand-alone black machine (FIG. 2). During this mode M2, the full process color image producing module 200 is turned off, the transfer/transport unit 320 is moved out of the first nip 204 with the intermediate transfer member 202, and is instead moved into the second nip 104 with the image bearing member 102 of black image output module 100.

To recap, the full process color image output module 200 and a black monochrome image output module 100 are advantageously arranged and mounted architecturally on opposite sides 322, 324 of the pre-fuser media path assembly 310 (that includes the reversible image transfer/transport unit 320) for delivering finished images X1, X2 to the fusing system 330. In this architectural arrangement, color images X1 and monochrome black images X2 will be delivered to the fusing system 330 with un-fused images oriented oppositely (top/bottom) relative to each other.

Accordingly, in this architectural arrangement, the fusing system 330 has a reversible common center pressure roller CPR (and hence separate heated fuser members 335, 345) for separately fusing color images X1 and monochrome black images X2. This advantageously permits complete separation of all high-cost color consumable and replaceable elements of the full color module 200 from low-cost monochrome black consumable and replaceable elements of the monochrome module 100. The result is low, stand alone type monochrome black image run costs with minimum additional size and complexity from what is otherwise a hybrid but fully-capable process color printing system.

As can be seen, there has been provided a hybrid printing system that includes (a) a media path assembly having an image transfer/transport unit for receiving and moving media to a fusing apparatus; (b) a process color image output terminal (IOT) assembly including first imaging components for forming and transferring color images onto the intermediate image receiving member, the color IOT assembly being mounted for forming a first image transfer nip with one of a first side and a second and opposite of the image transfer/transport unit; and (c) a monochrome image output terminal (IOT) assembly mounted opposite the process color image output terminal (IOT) assembly for forming a second image transfer nip with the other of the first side and the second and opposite of the image transfer/transport unit, the monochrome image output terminal (IOT) assembly including a moveable image bearing member and second imaging components for forming monochrome images on the image bearing member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A hybrid printing system for producing full process color prints and low cost monochrome prints, the hybrid printing system comprising:

(a) a machine frame;

(b) a media path assembly mounted within said machine frame and including a media supply source, and an image transfer/transport unit having a top side and a bottom side for receiving and moving media and images to a fusing apparatus;

(c) a full process color image output terminal (IOT) assembly including a moveable intermediate image receiving and carrying member and a first series of components for forming and transferring full process color images onto said intermediate image receiving and carrying member, said full process color IOT assembly being mounted for forming a first image transfer nip with one of said top side and said bottom side of said image transfer/transport unit;

(d) a monochrome image output terminal (IOT) assembly mounted opposite said full process color image output terminal (IOT) assembly for forming a second image transfer nip with an other of said top side and said bottom side of said image transfer/transport unit, said monochrome image output terminal (IOT) assembly including a moveable image bearing member and a second series of components for forming monochrome images on said image bearing member; and (e) a fusing system aligned with the image transfer/transport unit for receiving and fusing image carrying media, the fusing system including:

a first fusing apparatus for fusing full process color images;

a second fusing apparatus for fusing monochrome images; and a reversible common pressure roller moveable to form one of a first fusing nip and a second fusing nip, the first fusing nip being formed when the first fusing apparatus is activated and the second fusing nip being formed when the second fusing apparatus is activated.

2. The hybrid printing system of claim 1, including a controller connected to said full process color image output terminal (IOT) assembly, said monochrome image output terminal (IOT) assembly, and said image transfer/transport unit for controlling various operations thereof.

3. The hybrid printing system of claim 1, including a transfer/transport moving means for moving the image transfer/transport unit into and out of a first image transfer nip with the intermediate transfer member of the full process color image output terminal (IOT) assembly as well as into and out of a second image transfer nip with the monochrome image output terminal (IOT) assembly.

4. The hybrid printing system of claim 1, wherein the process color image output terminals include Cyan, Magenta Yellow and another Black, output terminals.

5. The hybrid printing system of claim 1, wherein the intermediate transfer member is an endless belt.

6. The hybrid printing system of claim 1, wherein the image transfer/transport unit includes an endless image transfer/transport belt.

7. The hybrid printing system of claim 1, wherein the monochrome image output terminal (IOT) assembly includes a drum photoreceptor.

8. The hybrid printing system of claim 2, including a controller for controlling operations of the full process color image output terminal (IOT) assembly, the monochrome image output terminal (IOT) assembly, and the positioning and direction of movement of the image transfer/transport unit.

9. The hybrid printing system of Claim 1, wherein said first fusing apparatus includes a pressure roller and a heated fusing belt forming a fusing nip.

10. The hybrid printing system of Claim 1, wherein said second fusing apparatus shares a common pressure roller with said first fusing apparatus and includes a heated fuser roller forming a fusing nip with said common pressure roller.

11. The hybrid printing system of claim 3, wherein the image transfer/transport unit includes a biased electrostatic transfer backup roll for assisting a xerographic image transfer onto a print media on said image transfer/transport unit and within one of said first image transfer nip and said second image transfer nip.

12. The hybrid printing system of claim 8, wherein said controller includes a full process color mode control for operating the hybrid printing system as a full process color machine, said full process color mode control including controls for (i) turning the monochrome image output terminal (IOT) assembly off, (ii) reversing a direction of the transfer/transport means, and (iii) moving the transfer/transport means into the first nip forming relationship with the full process color image output terminal (IOT) assembly, and out of the second nip forming relationship with the monochrome image output terminal (IOT) assembly.

13. The hybrid printing system of claim 8, including a black mode control for operating the hybrid printing system as a stand-alone black machine, said black mode control including controls for (i) turning the full process color image output terminal (IOT) assembly off, and (ii) reversing a direction of the transfer/transport means, and (iii) moving the transfer/transport means out of the first nip forming relationship with the full process color image output terminal (IOT) assembly, and into the second nip forming relationship with the monochrome image output terminal (IOT) assembly.

14. The hybrid printing system of Claim 1, wherein said image transfer/transport unit has a first end for forming said first image transfer nip and said second image transfer nip, and a second end adjacent said fusing system, and said second end thereof is moveable between an upper position and a lower position for aligning with said first fusing nip and said second fusing nip.

15. The hybrid printing system of claim 12, wherein said full process color mode control includes a first throughput speed that is relatively less than a second speed for operating the hybrid printing system in a black mode control that comprises turning the full process color image output terminal (IOT) assembly off, moving the transfer/transport means into the first nip forming relationship with the full process color image output terminal (IOT) assembly, and out of the second nip forming relationship with the monochrome image output terminal (IOT) assembly.

16. The hybrid printing system of claim 12, wherein said full process color image output terminal (IOT) assembly includes Cyan, Magenta and Yellow process color image output terminals and said controller includes a full process color mode control for operating the hybrid printing system as a full process color machine, and said full process color mode control includes controls for moving the transfer/transport means into the first nip forming relationship with the intermediate transfer member of the full process color image output terminal (IOT) assembly, out of the second nip forming relationship with the monochrome image output terminal (IOT) assembly.

17. The hybrid printing system of claim 1, wherein when the common pressure roller is moved to form one of the first fusing nip and the second fusing nip depending on which of the first image transfer nip and the second image transfer nip are formed by the one of the top side or the bottom side of the image transfer/transport unit.

* * * * *